US010500552B1

(12) United States Patent
Liu

(10) Patent No.: US 10,500,552 B1
(45) Date of Patent: Dec. 10, 2019

(54) DECANT DEVICE

(71) Applicant: Chang Hsien Liu, Taoyuan (TW)

(72) Inventor: Chang Hsien Liu, Taoyuan (TW)

( * ) Notice: Subject to any disclaimer, the term of this patent is extended or adjusted under 35 U.S.C. 154(b) by 0 days.

(21) Appl. No.: 16/542,504

(22) Filed: Aug. 16, 2019

Related U.S. Application Data

(63) Continuation-in-part of application No. 15/690,989, filed on Aug. 30, 2017.

(51) Int. Cl.
*B01F 3/04* (2006.01)

(52) U.S. Cl.
CPC ..... *B01F 3/04744* (2013.01); *B01F 3/04794* (2013.01); *B01F 2003/04865* (2013.01); *B01F 2215/0072* (2013.01)

(58) Field of Classification Search
CPC .... B01F 2215/0072; B01F 2003/04872; B01F 3/04744; B01F 2003/04865; B01F 3/04794
See application file for complete search history.

(56) References Cited

U.S. PATENT DOCUMENTS 1,164,453 A * 12/1915 Belles ..... A47J 31/14 222/189.07
2,187,558 A * 1/1940 Kushima ..... A47G 19/2288 215/12.1
2,471,189 A * 5/1949 Bartels ..... B65D 25/48 222/189.07
3,081,912 A * 3/1963 Goceliak ..... B65D 25/48 222/189.07
3,926,348 A * 12/1975 Lutzker ..... B65D 41/28 222/189.07
D487,227 S * 3/2004 Haley ..... D9/434
6,845,887 B1 * 1/2005 Granger ..... B65D 47/043 222/153.06
D635,823 S * 4/2011 Mauffette ..... D7/368
D660,078 S * 5/2012 Kehoe ..... D7/213
8,205,541 B2 * 6/2012 Barberio ..... B01F 3/0446 222/566
8,413,858 B2 * 4/2013 Rasmussen ..... B01F 3/0446 222/564
8,459,513 B2 * 6/2013 Harrower ..... B65D 47/043 220/378
8,894,042 B2 * 11/2014 Kilduff ..... A47G 19/2205 261/115
8,925,443 B2 * 1/2015 Agarwal ..... B01F 5/0426 99/323.1
9,027,774 B2 * 5/2015 Palmer ..... B65D 47/043 220/287
9,719,061 B2 * 8/2017 Buzzard ..... C12G 1/00
(Continued)

*Primary Examiner* — Stephen Hobson
(74) *Attorney, Agent, or Firm* — Rosenberg, Klein & Lee

(57) ABSTRACT

A decant device includes a tubular body being hollowed and having an upper end and a lower end being open. The lower end is capable of combining with a mouth of a cup. A dispenser is assembled in the tubular body. The dispenser has a plate body laterally connected to an inner wall of the tubular body. The plate body has a center portion and the plate body has a curved surface downwardly protruding from a bottom of the plate body and a recessed surface concaved from a top of the plate body. The plate body has a plurality of fan-shaped through holes surrounding the center portion, so as to form the plate body as turbine-shaped.

3 Claims, 6 Drawing Sheets

(56) References Cited

U.S. PATENT DOCUMENTS

| | | | | |
|---|---|---|---|---|
| 10,220,357 | B1 * | 3/2019 | Hsueh | B01F 3/04744 |
| 2008/0073383 | A1 * | 3/2008 | McDonald | B65D 47/06<br>222/500 |
| 2009/0324429 | A1 * | 12/2009 | Azimov | B01F 3/0446<br>417/198 |
| 2010/0124594 | A1 * | 5/2010 | Burroughs | A47G 19/2205<br>426/474 |
| 2011/0024925 | A1 * | 2/2011 | Mauffette | A47G 23/00<br>261/76 |
| 2012/0201942 | A1 * | 8/2012 | Kilduff | A47G 19/2205<br>426/474 |
| 2013/0319253 | A1 * | 12/2013 | Smith | B01F 3/04737<br>99/323.1 |
| 2014/0130681 | A1 * | 5/2014 | Castanon Delgado | C12G 1/00<br>99/323.1 |
| 2015/0021794 | A1 * | 1/2015 | Zhou | A47G 23/00<br>261/8 |
| 2016/0271574 | A1 * | 9/2016 | Buzzard | C12G 1/00 |
| 2018/0257045 | A1 * | 9/2018 | Simone | B01F 3/04241 |

* cited by examiner

DECANT DEVICE

This Application is being filed as a Continuation-in-Part of application Ser. No. 15/690,989, filed 30 Aug. 2017, currently pending.

BACKGROUND OF THE INVENTION

Field of the Invention

The present invention relates to a wineware, in particular to a decant device.

Description of the Prior Art

Once a decant procedure is applied to a wine (especially grape wine) before drinking, the aroma of the wine can be promoted and the acerbic taste of the wine can be softened, so that the taste of the wine would be much mellower. The principle for decanting wine is allowing the wine to contact air to oxidize the wine by a proper extent. Currently, market available decant devices are designed according to the aforementioned principle.

A conventional decant device is illustrated in FIG. 6. The decant device has a tubular body 4, a T-shaped channel is assembled in the tubular body 4, and the T-shaped channel is formed by a cone-shaped wine channel 41 and an air channel 42. In operation, the tubular body 4 is inserted into the bottle mouth 5 of a wine bottle, so that the wine channel 41 is in communication with the wine bottle. Hence, when the wine in the wine bottle is poured to a wine vessel via the decant device, the wine is flowing through the wine channel 41 and ambient airs are suctioned into the air channel 42 by the Venturi effect, so that the airs are mixed with the wine in the wine channel 41, thus, the wine can be decanted.

Because the shape of the wine bottle would greatly influence the texture of the bottle, the shape of the wine bottle is various, and the size of the bottle mouth 5 is not uniform. However, the conventional decant device is just suitable for a wine bottle in which the size of the bottle mouth 5 is corresponding to the tubular body 4; otherwise, the conventional decant device cannot be positioned on the wine bottle. As a result, the conventional decant device cannot be widely utilized.

Therefore, how to solve the problem is an issue.

SUMMARY OF THE INVENTION

One object of the present invention is to provide a decant device which is assembled on a drinking vessel. The decant device can be widely used for carrying on wines from wine bottles with different shapes and for decanting the wines. Furthermore, the through holes of the decant device are projecting downwardly, so that the wines in the decant device can be in contact with the ambient air with a greater surface area and in a longer time, thereby improving the decanting effect.

In view of these objects, the present invention provides a decant device comprising:

A tubular body being hollowed and having an upper end and a lower end being open, wherein the lower end is capable of combining with a mouth of a cup.

A dispenser assembled in the tubular body, wherein the dispenser has a plate body laterally connected to an inner wall of the tubular body, the plate body has a center portion, the plate body has a curved surface downwardly protruding from a bottom of the plate body and a recessed surface concaved from a top of the plate body; the plate body is formed as turbine-shaped and has a plurality of fan-shaped through holes and blades surrounding the center portion, each fan-shaped through hole lies between two adjacent blades, the blade is inclined from the recessed surface to the curved surface, a plurality of grooves is radially extending from the center portion and is communicating with the fan-shaped through hole, a shoulder is formed between the blade and the inner wall of the tubular body.

In one embodiment, a bore size of the upper end gradually increases from bottom to top, and the lower end has a threading portion formed on the inner wall thereof, the threading portion surrounds the curved surface.

The purposes and the advantages of the present invention can be understood from the embodiments and the drawings.

DETAIL DESCRIPTION OF THE PREFERRED EMBODIMENTS

Figure 1:
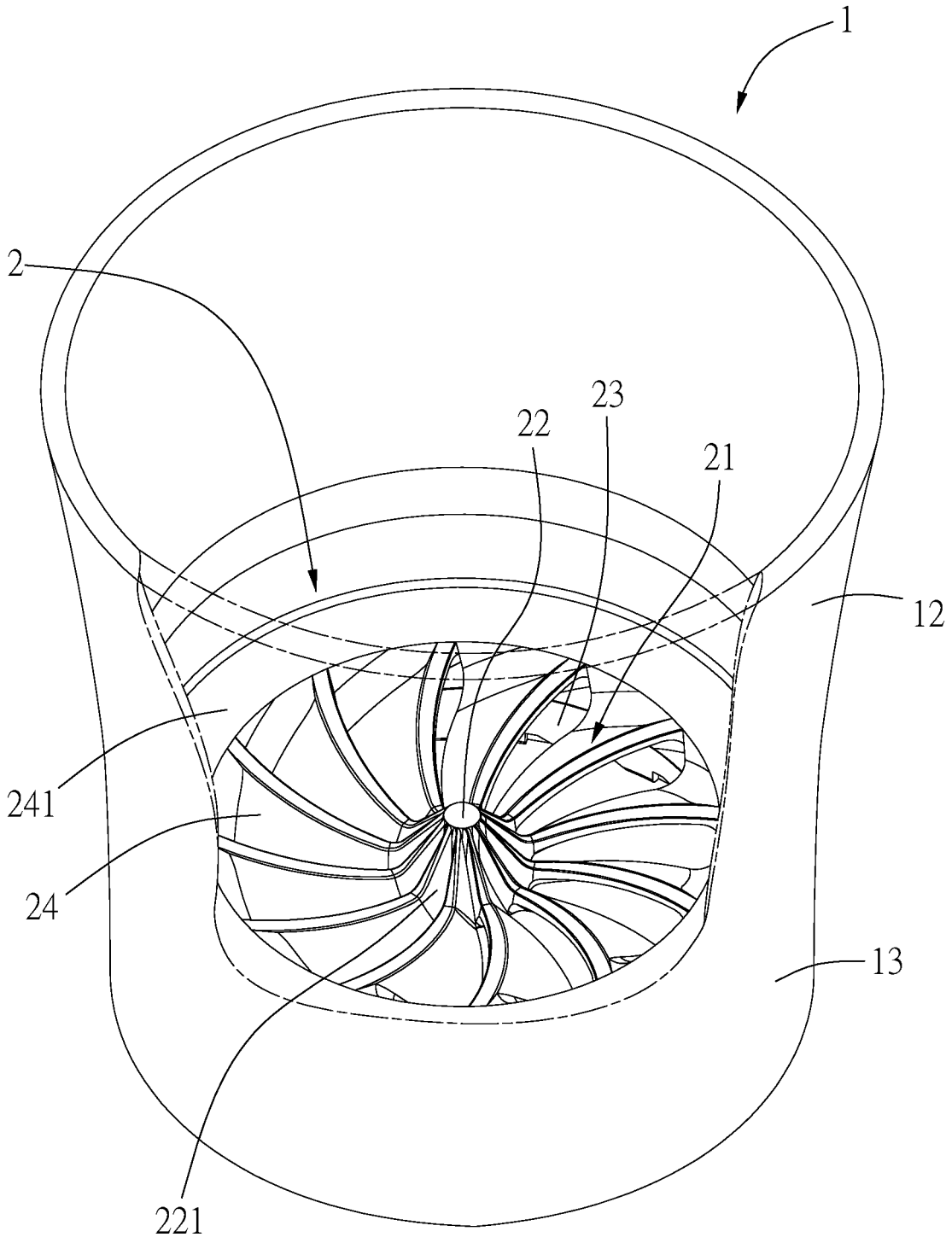
FIG. 1 illustrates a perspective view of a decant device of the present invention.
Figure 2:
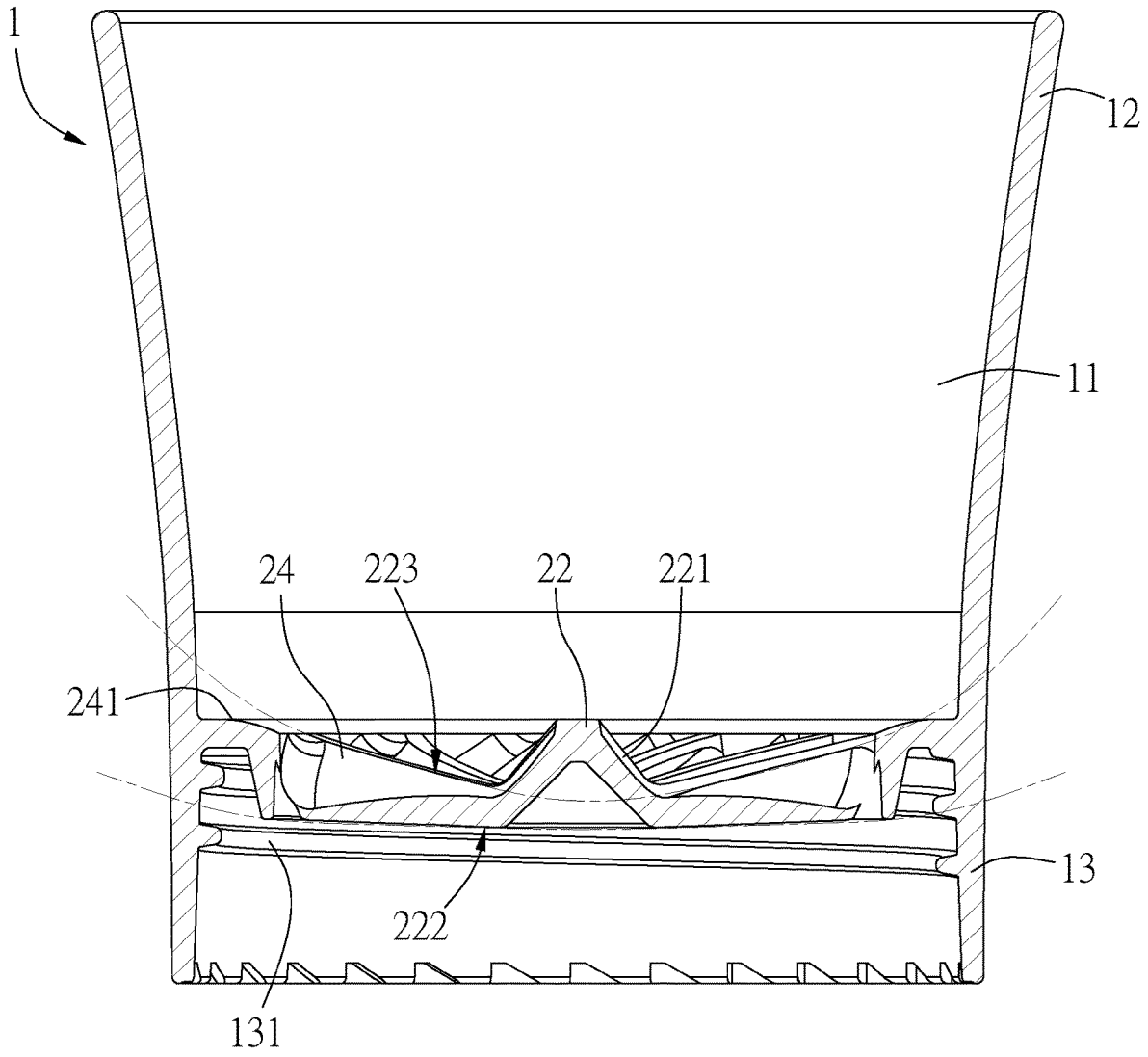
FIG. 2 illustrates a sectional view of the decant device.

Please refer to FIGS. 1 to 5, illustrating a decant device of the present invention. The decant device comprises a hollowed tubular body 1 enclosing a flow channel 11. An upper end 12 and a lower end 13 of the tubular body 1 are open. The bore size of the upper end 12 increases gradually from bottom to top. The lower end 13 is used to be combined with a mouth of a cup. The lower end 13 has a threading portion 131 formed on an inner wall thereof, and the threading portion 131 is used to combine with the corresponding threading portion of the mouth of the cup.

Moreover, a dispenser 2 is assembled in the tubular body 1. The dispenser 2 is laterally connected to the inner wall of the tubular body 1 and laterally located across the flow channel 11. The dispenser 2 has a plate body 21, and a periphery of the plate body 21 is connected to the inner wall of the tubular body 1. The plate body 21 has a center portion 22, and the plate body 21 has a curved surface 222 downwardly protruding from a bottom of the plate body 21 and a recessed surface 223 concaved from a top of the plate body 21 (The curved surface 222 and the recessed surface 223 are illustrated via dash lines which shown as the FIG. 2). Accordingly, the height of the center portion 22 of the plate body 21 is lower than the height of the periphery of the plate body 21.

Furthermore, the plate body 21 has a plurality of fan-shaped through holes 23 and blade 24. The fan-shaped through holes 23 and blades 24 surround the center portion 22, so as to form the plate body 21 as turbine-shaped. Each fan-shaped through hole 23 lies between two adjacent blades 24. The blade 24 is inclined from the recessed surface 223 to the curved surface 222. A plurality of grooves 221 is radially extending from the center portion 22 and is communicating with the fan-shaped through hole 23. A shoulder 241 is formed between the blade 24 and the inner wall of the tubular body 1.

Figure 3:
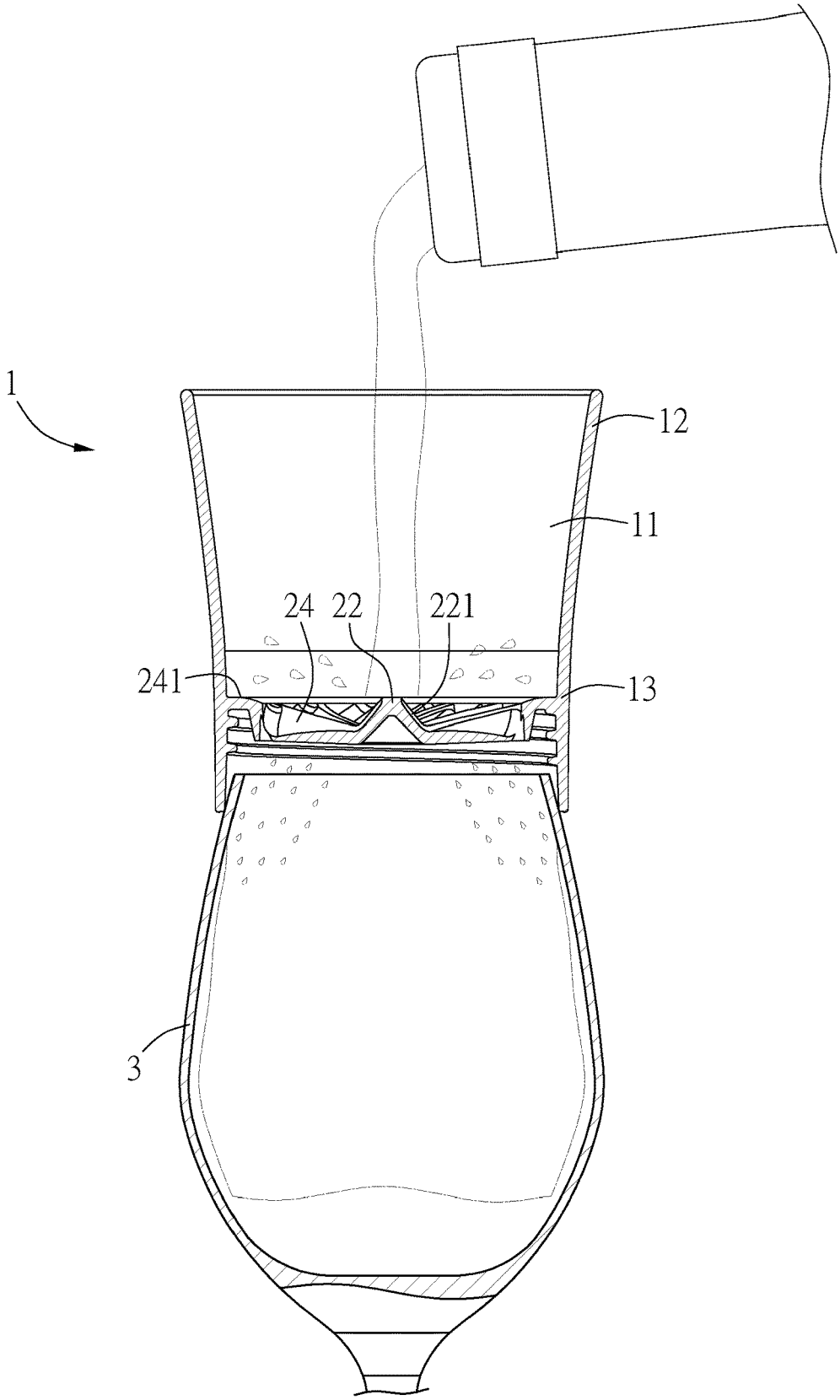
FIG. 3 illustrates an operational view of the decant device.
Figure 4:
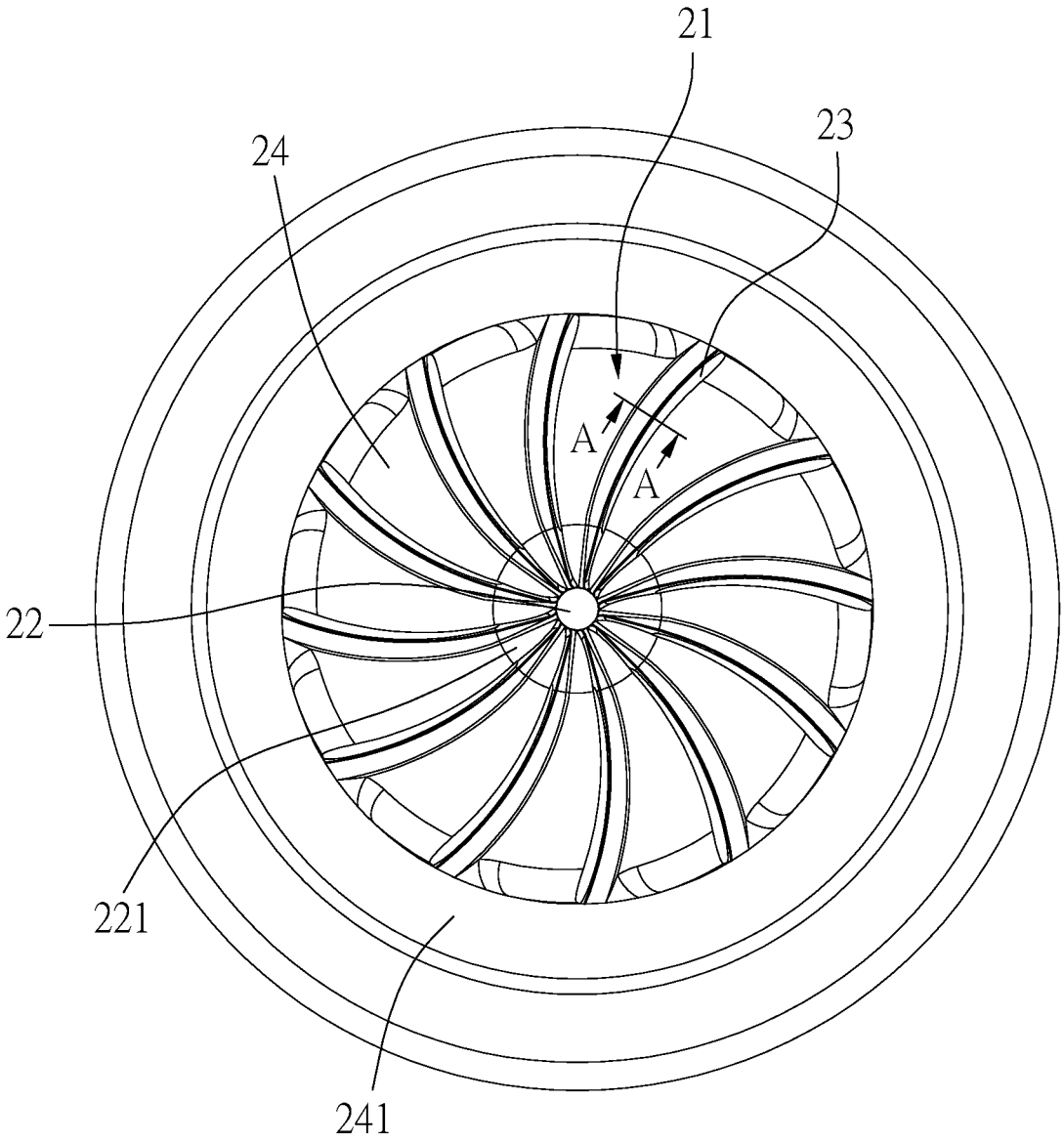
FIG. 4 illustrates a top view of the decant device.
Figure 5:
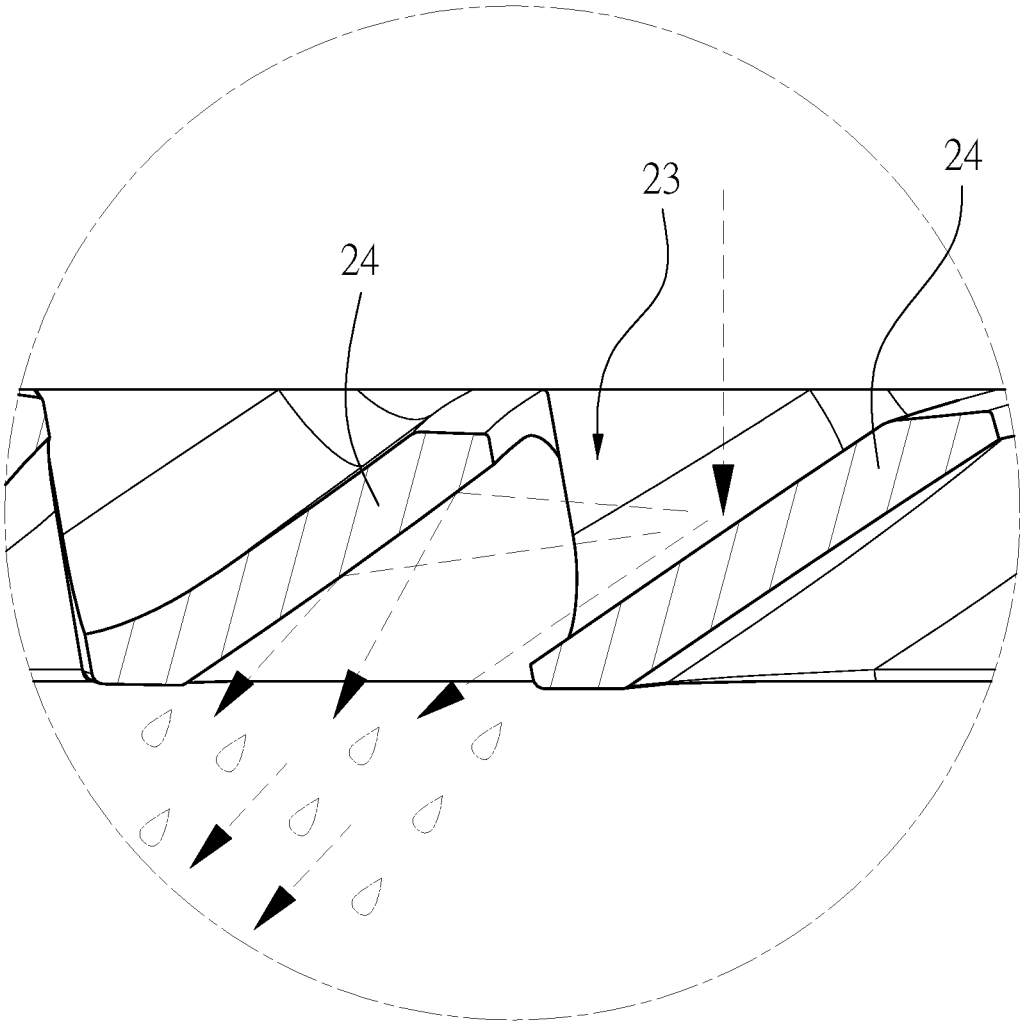
FIG. 5 illustrates a cross-sectional view along line A-A shown in FIG. 4.
Figure 6:
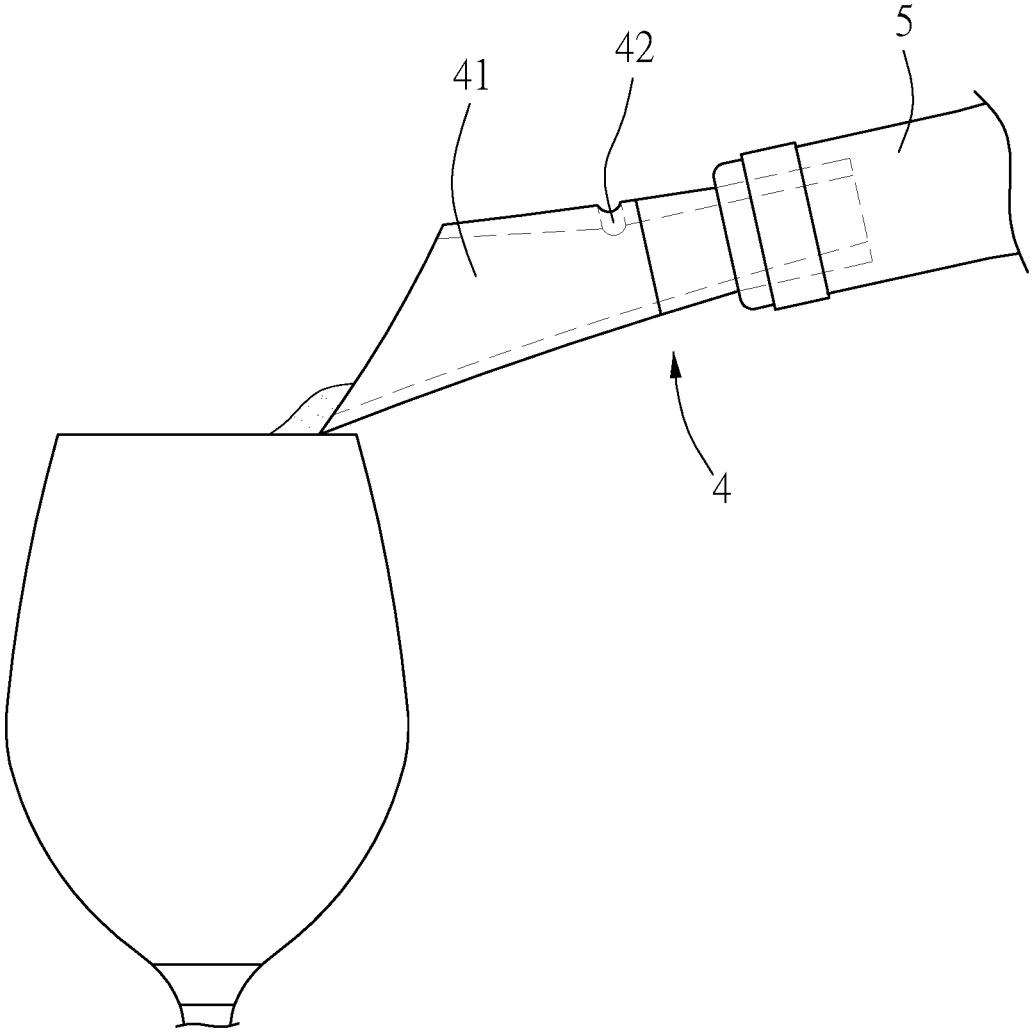
FIG. 6 illustrates an operational view of a conventional decant device.

Accordingly, in operation, as shown in FIG. 3, the lower end 13 of the tubular body 1 is fitted over or threaded with the mouth of a cup 3, so that the flow channel 11 is connected to the cup 3. When the wine is poured into the tubular body 1, the wine impacts the center portion 22 of the plate body 21 and splashes outwardly, and then the wine is flowing downward along the inner wall of the tubular body 1. Therefore, after the wine is fell on the plate body 21, the wine is collected at the center portion 22 because of the shape of the plate body 21, and the wine passes through the fan-shaped through holes 23 and falls in the cup 3. Hence, due to the profiles of the fan-shaped through holes 23, the wine can be spread everywhere and poured into the cup 3. Thus, when the wine is pouring into the cup 3, the wine can be in contact with and mixed with the air, thereby achieving the decanting effect.

The advantage of the present invention is that the decant device is assembled on the cup, so that the decant device can be used with wine bottles with different sizes. Accordingly, the decant device can be widely used and can be used conveniently. Moreover, the threading portion 131 surrounds the curved surface 222 so that a wine falling distance between the curved surface 222 and the cup 3 could be shortened. The plate body 21 is formed as turbine-shaped, the wine would be spirally shaken and sputtered via the fan-shaped through holes 23 for furtherly increasing the decanting effect. The grooves 221 cooperate with the shoulder 241, the wine impacts the grooves 221 and the shoulder 241 to create a sputtering effect and then flows into the fan-shaped through holes, aims to hugely increase the decanting effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A decant device, comprising:

a tubular body being hollowed and having an upper end and a lower end being open, wherein the lower end is capable of combining a mouth of a cup;

a dispenser assembled in the tubular body, wherein the dispenser has a plate body laterally connected to an inner wall of the tubular body, the plate body has a center portion, the plate body has a curved surface downwardly protruding from a bottom of the plate body and a recessed surface concaved from a top of the plate body; the plate body is formed as turbine-shaped and has a plurality of fan-shaped through holes and blades surrounding the center portion, each fan-shaped through hole lies between two adjacent blades, the blade is inclined from the recessed surface to the curved surface, a plurality of grooves is radially extending from the center portion and is communicating with the fan-shaped through hole, a shoulder is formed between the blade and the inner wall of the tubular body.

2. The decant device according to claim 1, wherein a bore size of the upper end gradually increases from bottom to top.

3. The decant device according to claim 1, wherein the lower end has a threading portion formed on the inner wall thereof, the threading portion surrounds the curved surface.

* * * * *